United States Patent [19]

Aström et al.

[11] Patent Number: 4,624,340

[45] Date of Patent: Nov. 25, 1986

[54] MOBILE WORKING PLATFORM

[75] Inventors: Jan Aström, Osby; Gunnar Eriksson, Älmhult, both of Sweden

[73] Assignee: AB Sjölanders Smides & Mek. Verkstad, Osby, Sweden

[21] Appl. No.: 795,126

[22] Filed: Nov. 5, 1985

[30] Foreign Application Priority Data

Nov. 16, 1984 [SE] Sweden ..... 8405743

[51] Int. Cl.[4] ..... B66F 11/04

[52] U.S. Cl. ..... 182/2

[58] Field of Search ..... 182/2, 141, 148, 63

[56] References Cited

U.S. PATENT DOCUMENTS

| | | | |
|---|---|---|---|
| 3,262,517 | 7/1966 | Malec | 182/2 |
| 3,357,517 | 12/1967 | Wagner | 182/2 |
| 3,411,606 | 11/1968 | Oldakowski | 182/2 |
| 3,708,037 | 1/1973 | Tranchero | 182/2 |
| 3,741,143 | 6/1973 | McKinley | 182/2 |
| 4,461,369 | 7/1984 | Amador | 182/2 |

*Primary Examiner*—Reinaldo P. Machado
*Attorney, Agent, or Firm*—Shapiro and Shapiro

[57] ABSTRACT

A mobile working platform, particularly a so-called under-bridge lift, comprising a parallelogram type boom which is horizontally and vertically pivoted to a vehicle and which at its end facing away from the vehicle has a turntable which is rotatable by means of a hydraulic motor and at its circumference supports the angular end of an inner arm which is vertically pivotable by means of a piston and cylinder assembly which is mounted adjacent to the circumference of the turntable approximately diametrically opposite the mounting point of the inner arm. By means of a hydraulic cylinder, the inner arm is vertically pivoted to an intermediate arm which by means of a further hydraulic cylinder is vertically pivoted to an outer arm which vertically pivotally supports a platform or cage. Between the turntable and the platform or cage, motion transfer means in the form of rods and chains extend to keep the platform or cage in a horizontal position independently of the angle of inclination of the boom and arms.

3 Claims, 3 Drawing Figures

MOBILE WORKING PLATFORM

The present invention relates to a mobile working platform, particularly for inspecting and carrying out work on the underside of bridges, a so-called under-bridge lift, comprising a parallelogram type boom which has its one end horizontally and vertically pivoted to support means to be secured to a vehicle, an arm assembly consisting of an inner arm, whose inner end is horizontally and vertically pivoted to the boom end facing away from the support means, an outer arm whose outer end is vertically pivoted to a platform, cage or the like, and at least one intermediate arm vertically pivoted at its oppposite ends to the inner and outer arm, hydraulic motors and piston and cylinder assemblies to provide movement of the arms and boom in relation to each other and the vehicle, as well as means to maintain the platform or cage substantially horizontal independently of the angle of inclination of the boom and arms.

Mobile working platforms, so-called lifts, are known in many different designs and comprise a plurality of interconnected arms, vertically pivotable by means of hydraulic cylinders, and sometimes at least the arm adjacent the platform or cage is of a telescoping design. Recently, there has been developed a special type of lifts, the under-bridge lift, which is adapted for inspecting and carrying out work on the underside of bridges. Available lifts of the last mentioned type are relatively large, heavy and complicated—one is mounted on a railroad car particularly for transporting armored cars—and are therefore also expensive.

The object of the invention is to provide a simple compact under-bridge lift which is also to be used as a conventional lift.

According to the invention, this is achieved in that the mobile working platform mentioned by way of introduction is designed such that the boom at its outer end has a turntable rotatable by means of a hydraulic motor which is attached to the end of the boom, said inner arm being mounted adjacent to the circumference of the turntable by means of an angular arm end portion which extends inward from the circumference of the turntable, that a piston and cylinder assembly for operating the inner arm is also mounted on the turntable adjacent to the circumference thereof approximately diametrically opposite the mounting point of the arm end portion, and engages the inner arm approximately midway between the ends thereof, and that at least one control rod is mounted radially outside the inner arm mounting point on the turntable and connected to a pivot axis at the outer end of the inner arm, on which pivot axis the inner end of the intermediate arm is mounted, said control rod being connected to a motion transfer system coupled to the platform or cage.

The invention will be described in detail below, reference being had to the accompanying drawings which illustrate an embodiment. In the drawings.

Figure 1:
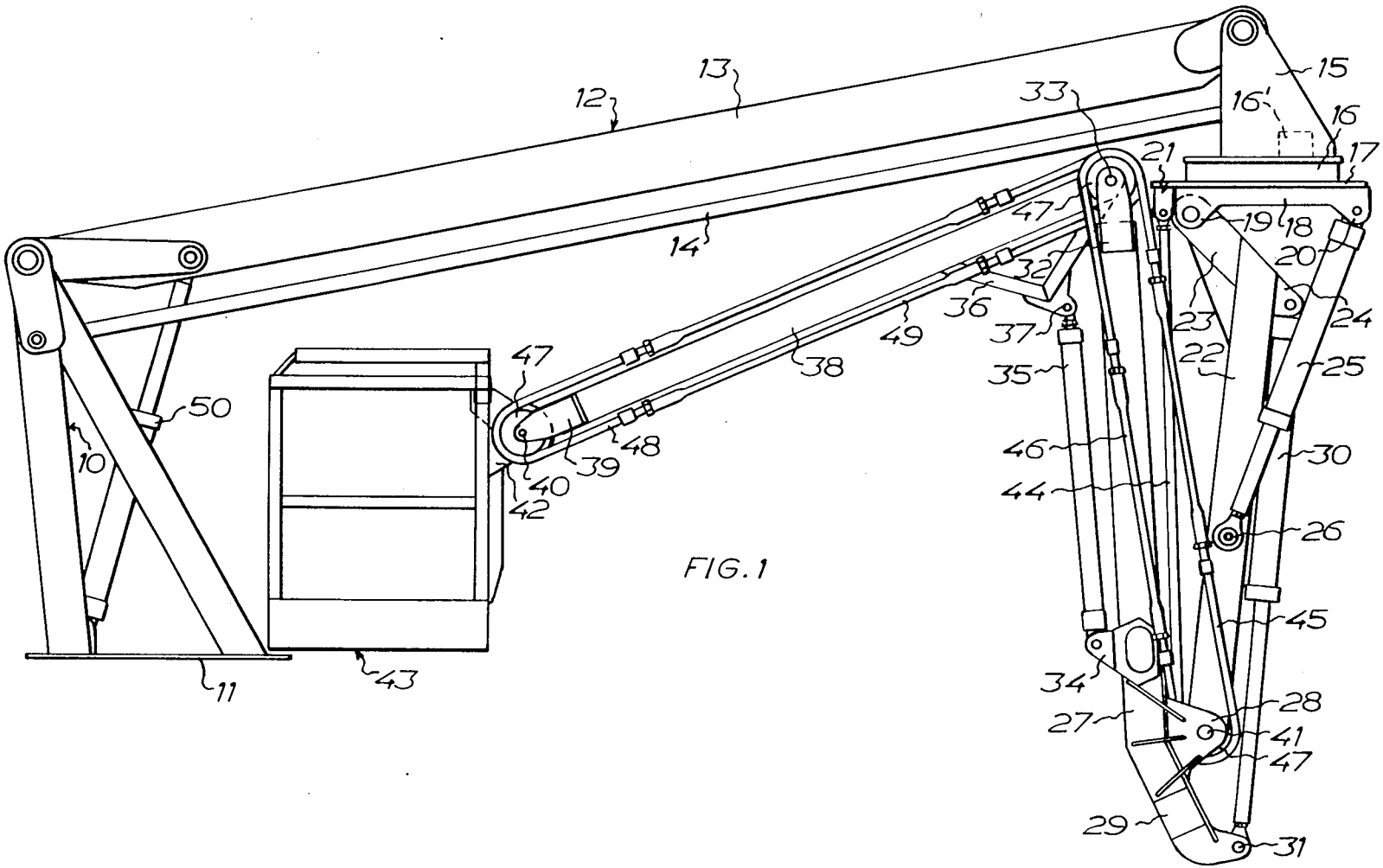
FIG. 1 is a lateral view of a working platform according to the invention in a collapsed state.

The mobile working platform structure shown in FIG. 1 comprises support means generally designated 10 and adapted to be mounted on a slew base plate as indicated at 11. This base plate is adapted to be secured to a suitable vehicle, for example a railroad car or a truck, preferably of the type having collapsible wheel pairs to allow driving of the truck on railway tracks. On the support means 10, a boom 12 is mounted comprising a main portion 13 preferably in the form of a square tube, and a rod 14 extending in parallel with the main portion. The main portion 13 and the rod 14 are mounted on the support means at a predetermined distance from one another and at the same distance from one another on a suspension member 15 as shown in FIG. 1. As a result, there is formed a parallelogram arrangement such that, when the boom 12 is pivoted by means of a hydraulic cylinder 50 attached to the support means 10, the suspension member 15 and the parts attached thereto are always maintained at a predetermined level independently of the angle of inclination of the boom 12.

At the suspension member 15, a turntable 16 is rotatably mounted which has a circumferential gear rim and at the underside an attachment plate 17. For rotation of the turntable 16, a hydraulic motor 16' is attached to the suspension member 15. After the support means 10 with the boom 12 have been mounted on the transport vehicle, the rod of the parallelogram arrangement is set in such a manner that the turntable 16 extends substantially in a horizontal direction.

The attachment plate 17 supports a holder 18 which extends diametrically in relation to the turntable 16 and has, adjacent and, as shown in the drawing, below the circumference thereof a fixation lug 19 at its one end and a fixation lug 20 at its opposite end. In the fixation lug 19, an inner arm 22 is vertically pivotally mounted by means of an angular arm portion 23. This arm portion extends inward towards the axis of the turntable, as appears from FIG. 1, and in its non-actuated state the arm therefore is below the turntable. In the fixation lug 20 of the holder 18, a hydraulic cylinder 25 is pivoted. The piston rod of the hydraulic cylinder is pivoted to the arm 22 approximately midway between the ends thereof. In the extension of the angular arm portion 23, a fixation lug 24 is attached to the arm 22, and a hydraulic cylinder 30 is pivoted in said lug 24. At the end of the arm 22 facing away from the turntable 16, an intermediate arm 27 is pivoted by means of bearing lugs 28 which are at some distance from the end of the arm 27 such that a projecting end portion 29 is formed which comprises a mounting point 31 to which the piston rod of the hydraulic cylinder 30 is pivoted as shown in FIG. 1. The intermediate arm 27 at its end facing away from the inner arm 22 is pivoted to an outer arm 38, and between the intermediate arm 27 and the outer arm 38 there is arranged a hydraulic cylinder 35 which is pivoted to an attachment 34 on the arm 27 and whose piston rod is pivoted to a mounting point 37 on a bracket-shaped portion 36 adjacent the end of the arm 38 facing the intermediate arm 27. The outer arm 38 at its end facing away from the intermediate arm 27 is vertically pivoted to a bracket member 42 rigidly attached to the working platform or cage 43.

Figure 3:
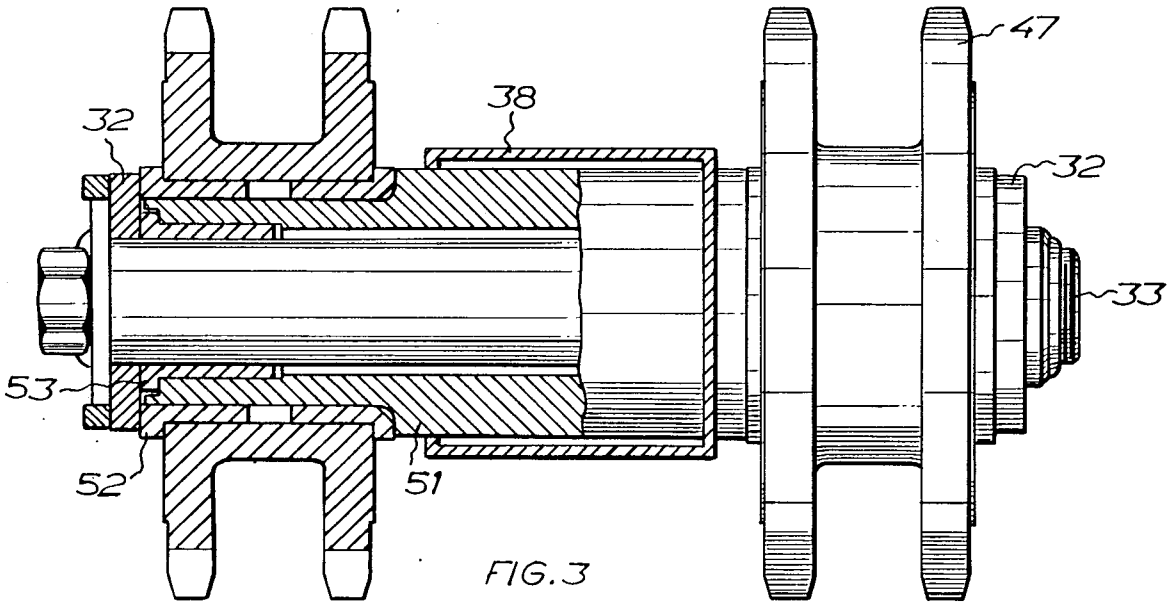
FIG. 3 is a projection of a pivot axis for the working platform in FIG. 1.

The pivotal interconnection of the arms 27 and 38 will now be described in detail with reference to FIG. 3. As indicated in FIG. 1, the arm 27 at its end facing the outer arm 38 has a pair of fork arms 32. A pivot axis 33 (FIG. 3) extends through these fork arms 32. On the pivot axis, a sleeve 51 is mounted by means of bronze bushings 53 adjacent each end of the axis. Adjacent its opposite ends, the sleeve 51 is recessed for receiving bronze bushings 52, and rigidly interconnected wheel pairs 47 are mounted on these bronze bushings. To the central portion of the sleeve 51, the end portion of the outer arm 38 is attached by welding, as indicated in FIG. 3. It will appear that the sleeve 51 is rotatable independently of the pivot axis 33, while the fork arms 32 and the wheel pairs 47 are rotatable independently of the sleeve and pivot axis.

The intermediate arm 27 may be mounted on the inner arm 22 in substantially the same manner as shown in FIG. 3, the pivot axis 41 corresponding to the pivot axis 33, the fork arms 32 to the fixation lugs 28, and the end portion of the arm 38 to the end portion of the arm 22. The only difference is that here the inner wheel in each wheel pair is replaced by a projecting lug for reasons which will be described in detail below. The bearing between the outer arm 38 and the cage 43 may be designed in the same manner, the fork arms 39 of the outer arm 38 replacing the fork arms 32 as shown in FIG. 3, and the pivot axis 40 replacing the pivot axis 33. In this case, however, only one wheel 47 is mounted at each end of the sleeve, and this wheel is rigidly connected to the sleeve 51 like the attachment bracket 42 of the cage 43, which corresponds to the end portion of the arm 38 in FIG. 3. In this embodiment, the sleeve as well as the bracket 42 will be turned when the wheels 47 are turned.

It is essential that the cage 43 be kept horizontal independently of the angle of inclination of the boom and arms, and for this reason two rods 44 are pivoted to the turntable 16 at a point 21 outside the mounting point 19 of the arm 22. The rods 44 are pivoted to the previously mentioned lugs on the sleeve 51 of the pivot axis 41, said lugs being rigidly connected to the toothed wheels 47. About each of the toothed wheels 47 on the sleeve of the pivot axis 41, there is arranged a chain run 45 which by means of two rods 46 of adjustable length are connected to a corresponding chain run 45 which is arranged about the wheels 47 of the pivot axis 33. Correspondingly, two chain runs 48 interconnected by means of rods 49 of adjustable length are arranged about the toothed inner wheels on the pivot axis 33 and the wheels 47 on the pivot axis 40, respectively. This motion transfer system functions in the following manner. If the arm 22 is swung by the hydraulic cylinder 25, the rods 44 will actuate the lugs connected with the wheels 47 on the pivot axis 41, thereby turning the wheels 47. This implies that the chain and rod assemblies 45, 46 arranged about the wheels 47 move in one or the other direction such that the toothed wheels 47 on the pivot axis 33 turn, which again causes a motion of the chain and rod assemblies 48 and 49 and, consequently, a rotation of the toothed wheels 47 on the pivot axis 40. Since these wheels are rigidly connected to the cage bracket 42, said bracket will be pivoted accordingly. Correspondingly, each movement of the intermediate arm 27 or the outer arm 38 will, with the arrangement shown, result in a movement of the motion transfer system such that the horizontal position of the cage is maintained.

When using the working platform structure preferably secured to a truck platform, the arms 22, 27 and 38 with the cage 43 are first swung by rotation of the turntable 16 by means of the associated hydraulic motor, the cage thereby leaving its transport position on the truck platform. Then the support means 10 are swung by means of the associated drive, and the boom 12 is swung by means of the hydraulic cylinder 50 to a suitable starting position, e.g. such that the boom 12 extends beyond a bridge parapet and with the cage suitably positioned to allow a person to enter it. Operating a control panel in the cage, this person can then swing the cage out and down below the bridge by a combination of movements of the arms 22, 27 and 38.

Figure 2:
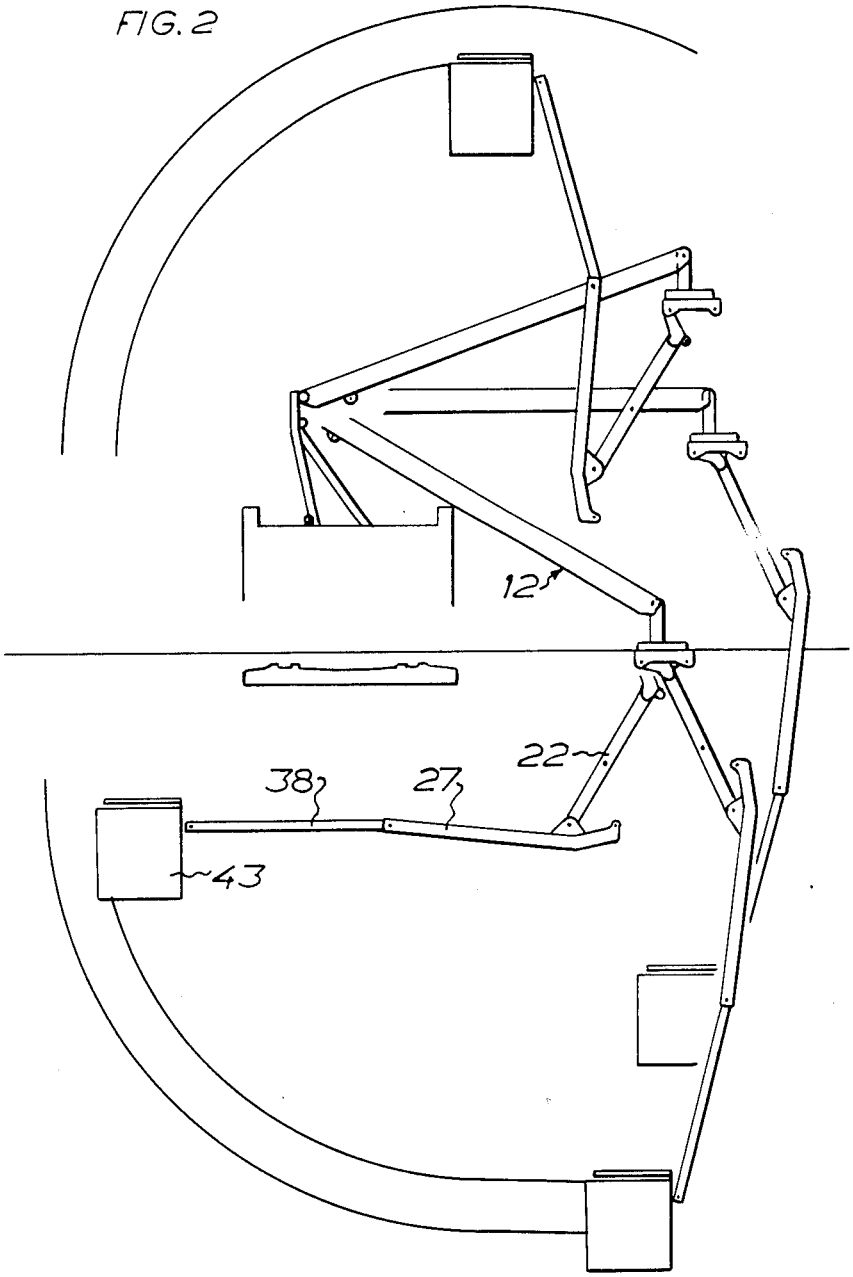
FIG. 2 shows schematically various positions of the working platform in FIG. 1.

FIG. 2 gives a hint of the possibilities of adjusting the cage 43 by means of the structure according to the invention, and it will appear that although the structure according to the invention is particularly useful as an under-bridge lift, it may also be used for inspecting and carrying out work on objects above the erection level.

What we claim and desire to secure by Letters Patent is:

1. A mobile working platform for inspecting and carrying out work on the underside of bridges, a so-called under-bridge lift, comprising (a) a boom, said boom being of parallelogram type and having its one end horizontally and vertically pivoted to support means which are secured to a vehicle;

(b) an arm assembly, said arm assembly comprising an inner arm whose inner end is horizontally and vertically pivoted to the boom end facing away from said support means, an outer arm whose outer end is vertically pivoted to a cage, and at least one intermediate arm vertically pivoted at its opposite ends to said inner and outer arms;

(c) hydraulic motors, including piston and cylinder assemblies to provide movement of said arms and boom relative to each other and to the vehicle;

(d) means to maintain said cage substantially horizontal independently of the angle of inclination of said boom and said arms;

(e) a turntable, said turntable being rotatably attached, by means of a hydraulic motor, to the boom end facing away from said support means;

(f) an angular arm end portion on said inner arm, by means of which said inner arm is mounted on said turntable adjacent to the circumference thereof and which extends inwardly to the centre of the turntable on the underside thereof, said piston and cylinder assembly for operating said inner arm also being mounted on the turntable adjacent to the circumference thereof diametrically opposite the mounting point of said angular arm end portion and engaging said inner arm between the ends thereof;

(g) at least one control rod, said rod being mounted radially outside the mounting point of said inner arm end portion on said turntable;

(h) a pivot axis at the outer end of said inner arm, to which pivot axis said control rod is connected as well as the inner end of said intermediate arm; and (i) a motion transfer system on said intermediate arm and said outer arm, the outer end of said control rod and said cage, respectively, being connected to the opposite ends of said system.

2. A working platform as claimed in claim 1, comprising a first fixation lug which is mounted on said inner arm in the extension of the angular end portion of said inner arm; and a second fixation lug which is formed by a portion of said intermediate arm which extends beyond said intermediate arm mounting point on said inner arm, to which fixation lugs a piston and cylinder assembly is pivoted for controlling the intermediate arm.

3. A working platform as claimed in claim 1 comprising a pivot axis assembly by which said intermediate arm and said outer arm are pivotally interconnected and which consists of an interiorly and exteriorly machined sleeve which comprises a pair of toothed wheels being mounted thereon on either side of a central portion on which said outer arm is mounted, and an inner pivot axis extending through said sleeve and having its ends connected each to one fork arm at the end of said inner arm, a first pair of chains engaging two of said toothed wheels and extending along said intermediate arm to engage two toothed wheels attached to the sleeve of a correspondingly shaped pivot axis assembly between said inner arm and said intermediate arm, said sleeve having, instead of said second pair of toothed wheels, a pair of lugs, each of which is pivoted to a control rod connected to said turntable, and a second pair of chains engaging the two other wheels of the toothed wheels on said first-mentioned pivot axis assembly and extending along said outer arm to engage two toothed wheels on the sleeve of a pivot axis assembly designed in the same manner as the two first-mentioned pivot axis assemblies and positioned between said outer arm and said cage which is supported by a bracket rigidly secured to the adjacent sleeve.

* * * * *